US005269382A

United States Patent [19]

Ottestad

[11] Patent Number: 5,269,382

[45] Date of Patent: Dec. 14, 1993

[54] IMPACT DEVICE

[75] Inventor: Jack B. Ottestad, La Jolla, Calif.

[73] Assignee: ESCO Corporation, Portland, Oreg.

[21] Appl. No.: 880,021

[22] Filed: May 8, 1992

[51] Int. Cl.[5] ..... B25D 9/14; E02F 3/32

[52] U.S. Cl. ..... 173/200; 173/206; 173/128; 91/229; 299/37

[58] Field of Search ..... 173/200, 206, 207, 208, 173/128, 131; 91/173, 224, 229; 299/37

[56] References Cited

U.S. PATENT DOCUMENTS

| | | | |
|---|---|---|---|
| 2,228,445 | 1/1941 | De Velbiss . | |
| 2,303,666 | 12/1942 | Souter . | |
| 3,065,557 | 11/1962 | Pewthers . | |
| 3,101,796 | 9/1963 | Stall et al. | 91/229 |
| 3,375,596 | 4/1968 | Bacquie . | |
| 3,563,316 | 2/1971 | Shatto . | |
| 3,633,683 | 1/1972 | Shatto, Jr. . | |
| 3,645,021 | 2/1972 | Sonerud . | |
| 3,714,866 | 2/1973 | Ottestad . | |
| 3,722,331 | 3/1973 | Radulescu | 173/164 |
| 3,795,070 | 3/1974 | Bronson et al. . | |
| 3,822,633 | 7/1974 | Ottestad . | |
| 3,828,951 | 8/1974 | Fleming . | |
| 3,924,513 | 12/1975 | Ottestad . | |
| 4,111,269 | 9/1978 | Ottestad | 173/207 |
| 4,222,462 | 9/1980 | Ottestad . | |
| 4,262,917 | 4/1981 | Ottestad . | |
| 4,286,929 | 9/1981 | Heath et al. | 91/229 |
| 4,550,784 | 11/1985 | Ottestad . | |
| 4,783,123 | 11/1988 | Ottestad . | |
| 4,892,358 | 1/1990 | Ottestad . | |
| 4,892,359 | 1/1990 | Ottestad . | |
| 4,959,915 | 10/1990 | Roussin et al. . | |
| 5,060,734 | 10/1991 | Anderson et al. | 173/128 |
| 5,065,824 | 11/1991 | Ottestad | 173/206 |

FOREIGN PATENT DOCUMENTS

| | | |
|---|---|---|
| 972397 | 8/1975 | Canada . |
| 1005292 | 2/1977 | Canada . |
| 0039373 | 11/1981 | European Pat. Off. . |
| 1236444 | 3/1967 | Fed. Rep. of Germany . |
| 2437468 | 1/1976 | Fed. Rep. of Germany . |
| 92888 | 4/1957 | Norway . |
| 977596 | 11/1982 | U.S.S.R. . |
| 1421839 | 1/1976 | United Kingdom . |
| 1421840 | 1/1976 | United Kingdom . |
| 1595149 | 8/1981 | United Kingdom . |

OTHER PUBLICATIONS

ESCO Brochure Entitled "Principle of Operation," publicly available at least as early as 1991.

*Primary Examiner*—Scott Smith

*Attorney, Agent, or Firm*—Banner, Birch, McKie & Beckett

[57] ABSTRACT

An impact device for breaking up and separating hard material comprises an actuating system for providing a faster cycle rate as well as an increased impact force. More specifically, the device includes a pair of pistons movably arranged in a cylinder to cooperate in compressing the gaseous component prior to initiating the blow. A closed tube is provided to fluidly interconnect opposite chambers adjacent the two pistons to coordinate the different movements of the pistons to effect the desired compression. The impact device is particularly well suited for use in an impact bucket.

27 Claims, 8 Drawing Sheets

IMPACT DEVICE

FIELD OF THE INVENTION

The present invention pertains to an impacting device, and in particular, to an impact bucket.

BACKGROUND OF THE INVENTION

Impact devices are often used in demolition, excavation, mining and the like endeavors, to break and separate material for easier removal One common impact device is an impact hammer, such as illustrated in U.S. Pat. No. 3,363,512 to Ottestad. Impact hammers generally include a fluid-driven, reciprocal piston which is struck against a spike or spade shaped tool element to penetrate and break up the material Although these hammers can be hand manipulated, they are usually mounted on the end of a boom of a carrier, such as a back hoe. These hammers are effective in penetrating hard materials, such as concrete or stone. However, the hammers generally only form a small bore or opening with each pass into the material. As a result, a number of passes are often required to effectively break and separate the material. Moreover, after the material is sufficiently broken, it must be removed by a bucket. The use of a bucket requires that the hammer be exchanged for the bucket or that an independent carrier with a bucket be used. These options undesirably increase the downtime and cost of the operation.

As can be appreciated, ordinary buckets do not form good devices for the break up and separation of hard material. Although the buckets can be struck against the material, it cannot match the speed or force of a conventional impact hammer. Further, buckets are not ordinarily fabricated to withstand these types of impact loads. To increase the penetration capacity of buckets, some artisans have coupled vibration inducing mechanisms to the front teeth of the bucket. Two examples of this type of construction are illustrated in U.S. Pat. No. 3,645,021 to Sonerud and West German Patent No. 24 37 468. These devices, however, have little effect when encountering a hard material Impact buckets were specifically developed to perform the dual role of an impact hammer and a bucket. More particularly, impact buckets are buckets which have impact hammer units incorporated in their construction. The hammers are operatively connected to a movable front edge which acts as the impact tool element. Examples of such impact buckets are disclosed in U.S. Pat. Nos. 4,892,358 and 4,892,359 to Ottestad. These tools can effectively penetrate and separate pieces from a hard material. Further, the tool element is an elongated member which can quickly cut across an elongated portion of the material. Impact buckets also function to reduce the time and cost involved in completing a project by performing the two previously independent operations of breaking and removing the material with one device.

Nevertheless, the inclusion of the impact hammer into the bucket, has resulted in a significant reduction in the available bucket space for collection of the broken material. Heretofore, if more bucket space was desired, a smaller hammer unit was used. The use of a smaller hammer though produced less impact force. On the other hand, if a larger hammer unit was employed for greater impact force, bucket space was sacrificed.

Further, the positioning of a hammer within a bucket places constraints on orienting the impacting device with respect to the ground. Reference is had to FIG. 10 to better illustrate these design constraints. In particular, the bucket 1 is typically supported on the end of a boom by a pair of pins 2 and 3. One pin 2 (i.e., the one closer to the bucket opening) functions as the pivot point for bucket movement, while the force F for effecting movement of the bucket 1 is driven through the other pin 3. This operation causes the bucket 1 to move in an arcuate swinging motion, and thereby create a curved cut line C into the ground G. As can be appreciated, the bucket 1 must be designed so that its back corner 4 clears the curved cut line C.

The hammer 5 is positioned in the lower regions of the bucket so that the impact blade 6 lies along the front lip 7 of the bucket 1. The effectiveness of a hammer to break up hard ground (e.g., rock, frozen ground, etc.) depends upon the angle of attack and the crowd force being optimally set. The angle of attack A is defined as the angle which is formed by the intersection of the longitudinal axis of the impact blade and a line extending between the pivot axis (i.e., pin 2) and the tip of the impact blade. The crowd force is dependent on the ratio between the distance between the two pins $L_2$ and distance between the pivot pin and the tip of the impact blade $L_1$. As a result, these factors have limited the ability of designers to employ ever larger impact devices into buckets.

More specifically, the use of a more forceful hammer has heretofore required the hammer to have a correspondingly greater length. The increased hammer size has, in turn, resulted in an increased bucket depth An increase in the bucket depth, without further modifications to the bucket's design, would create clearance problems for the back corner 4 of the bucket 1 with respect to the cut line C. Hence, in order to accommodate the use of a larger hammer, the bucket must be reshaped such that the angle of attack A is lessened, the distance between the pivot pin and the blade tip $L_1$ is lengthened or both In either case, the resulting changes to the angle of attack and/or crowd force offsets the increased power of the hammer in breaking up the ground.

SUMMARY OF THE INVENTION

The present invention pertains to an impact device having a novel construction which provides an enhanced rate of impact and impact force. The enhanced impact capacity is attained without a concomitant significant increase in the length of the device. The impact tool thus involves an impact unit which is usable independently, but which is particularly well suited for use in an impact bucket.

More specifically, the present invention includes a reciprocal head for striking the tool element, a power piston which is fluidly driven to force the head against the tool element, and an accumulator piston which is uniquely incorporated into the driving system to reduce the time period between successive blows. The construction of the driving system also significantly enhances the impact force of the device without a significant increase in the unit's length. The coordination of the pistons is achieved by a closed tube which selectively interconnects the chambers for the power and accumulator pistons. The coordinated movement of the pistons causes a quicker and increased compression of the gaseous component.

While the present impact unit has applicability independently, it is particularly well suited for use in an impact bucket. Specifically, the impact unit is constructed at right angles to thereby provide for a significantly increased force to be delivered to the tool element without significantly increasing the depth of the bucket. Accordingly, a more powerful impact unit can be used without requiring a concomitant deviation from the optimum angle of attack and crowd force of the bucket.

DETAILED DESCRIPTION OF THE PREFERRED EMBODIMENTS

An impact hammer unit 10 (FIGS. 1-3) in accordance with the present invention can be constructed independently or in conjunction with an impact hammer bucket 12. The details of the impact hammer's construction and operation will be discussed only in connection with an impact bucket. However, those skilled in the art will appreciate that the same concepts could be used in an independent hammer unit. The primary differences in a unit employed in a bucket rather than used independently is that: (1) the unit is preferably bent at a right angle rather than oriented in a linear configuration; and (2) the tool element is generally a much broader member.

In addition, the bucket and impact hammer unit are at times described in directional terms, such as front, rear, bottom, top and sides, right and left, forward and backward, and the like. These terms, however, are all relative and are only used for illustration and clarity of description with respect to the accompanying drawings.

Figure 1:
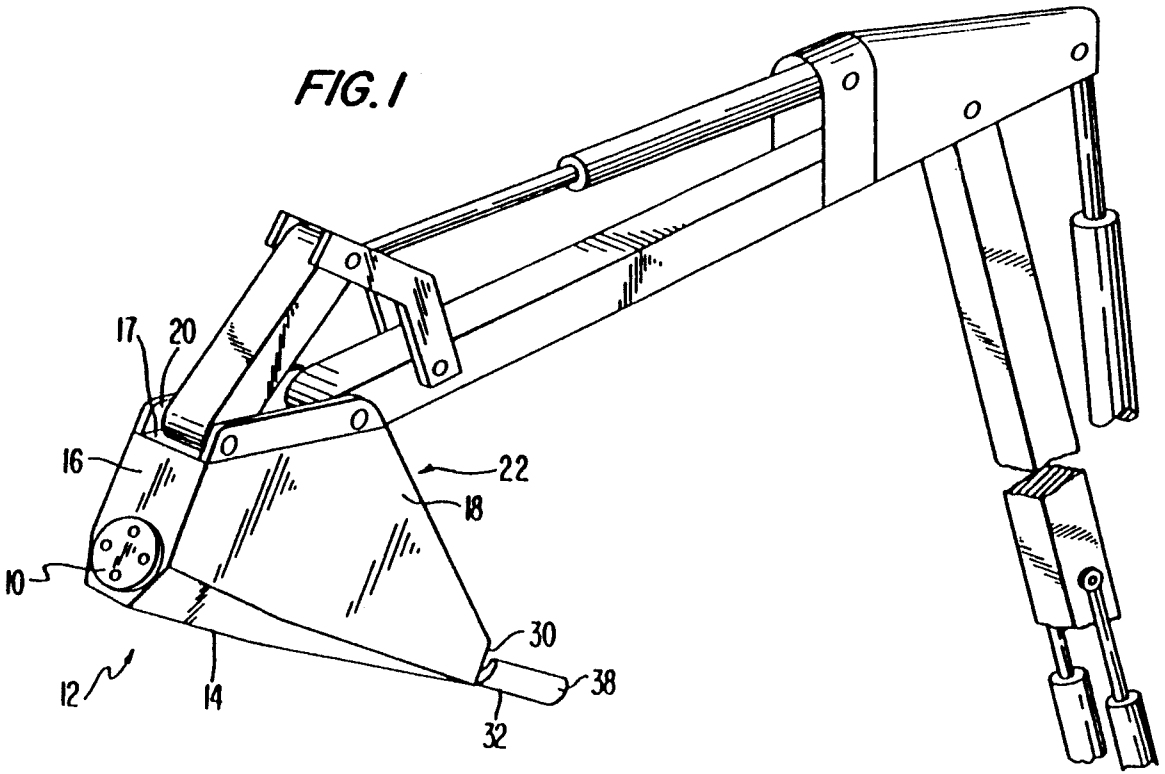
FIG. 1 is a perspective view of an impact bucket of the present invention mounted on a boom of a carrier.
Figure 7:
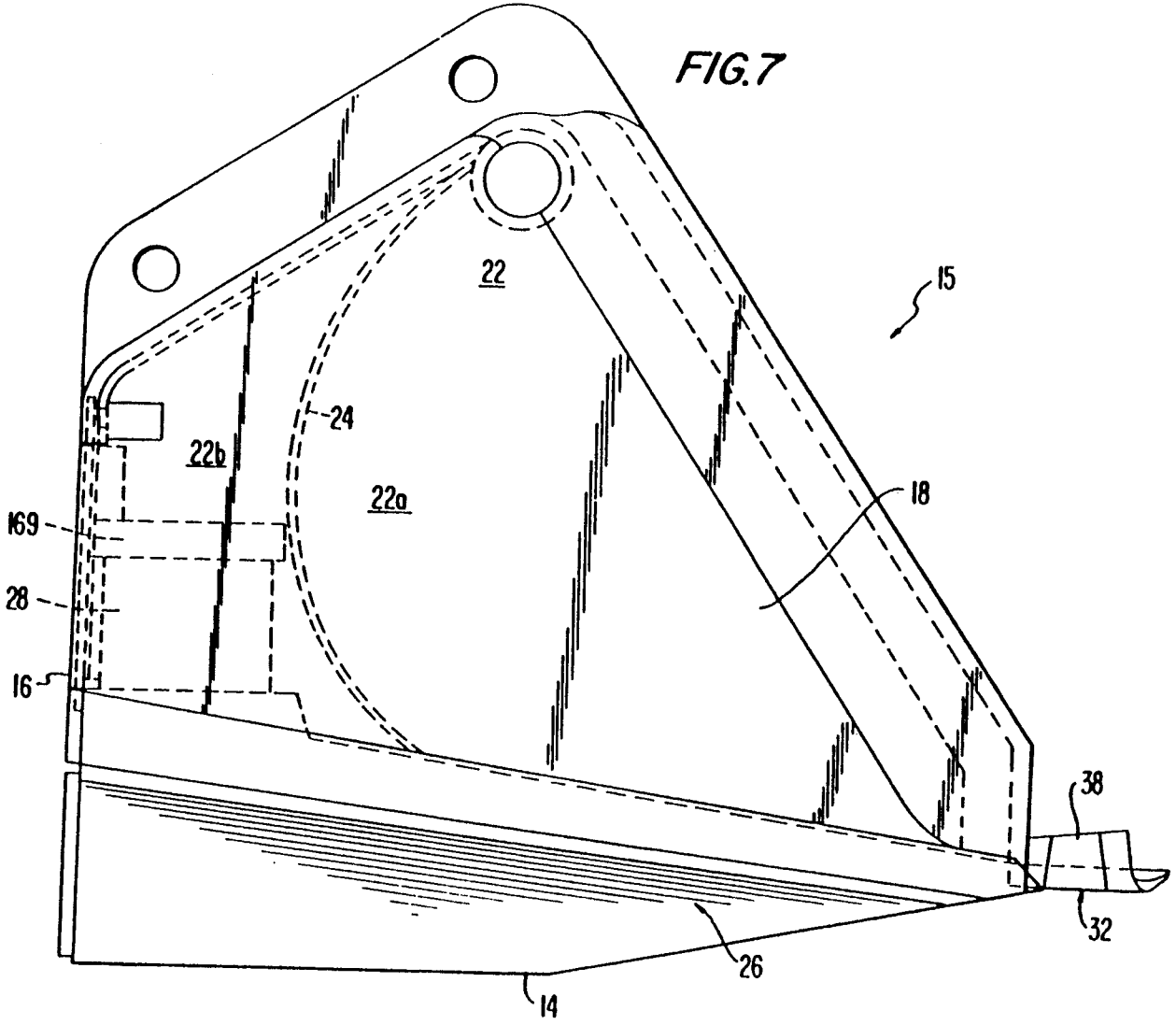
FIG. 7 is a side view of the impact bucket
Figure 8:
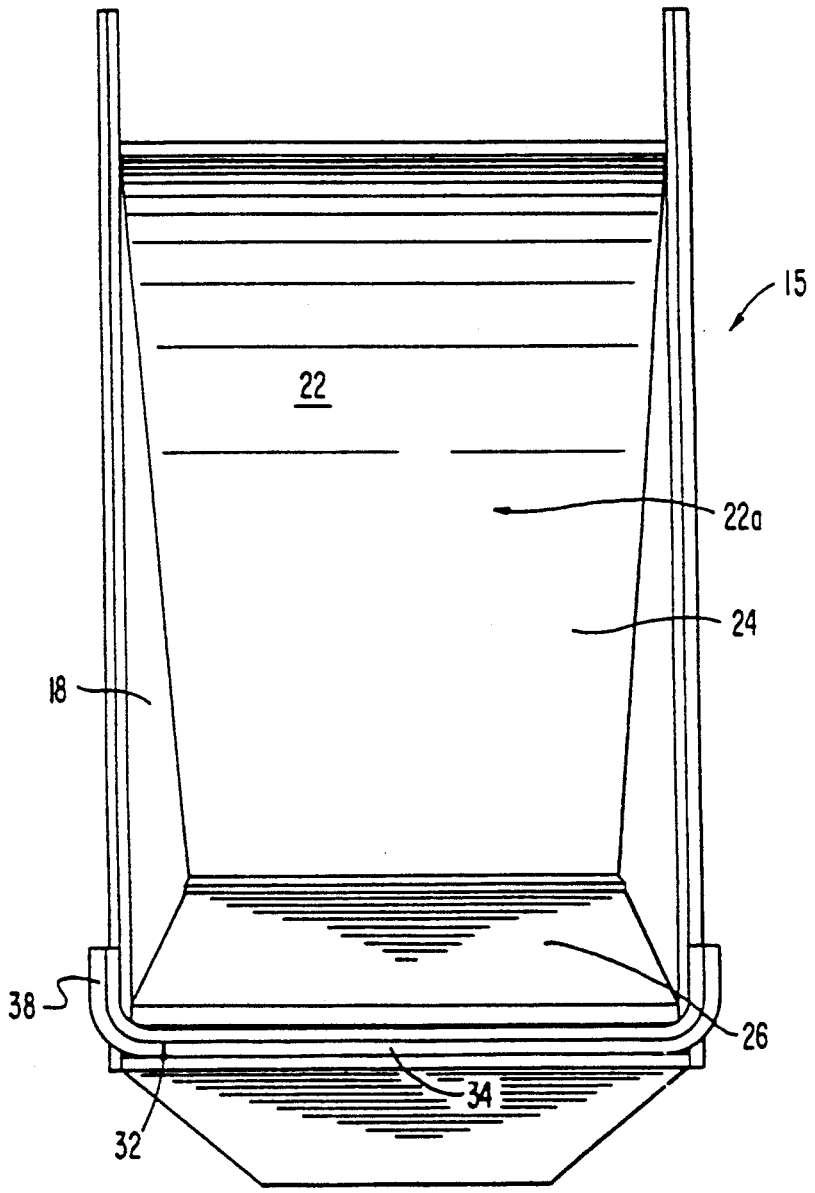
FIG. 8 is a front view of the impact bucket
Figure 9:
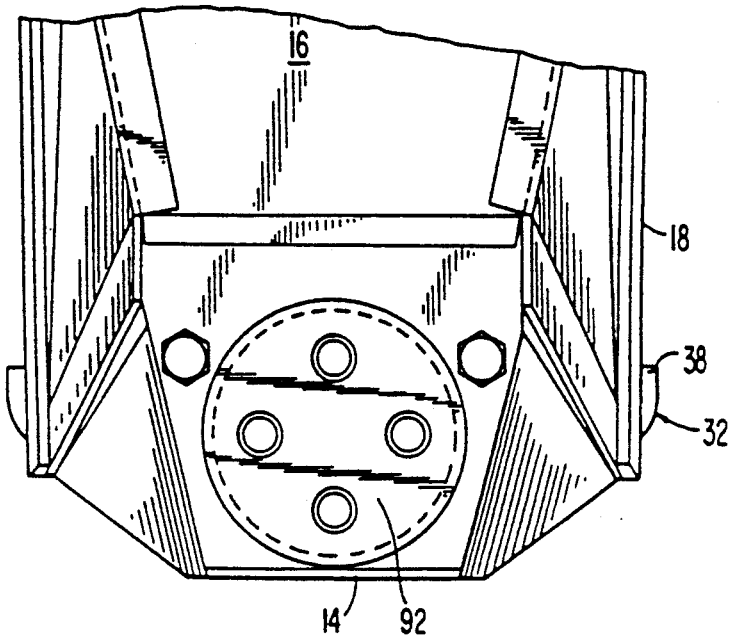
FIG. 9 is a rear view of the lower regions of the impact bucket.
Figure 10:
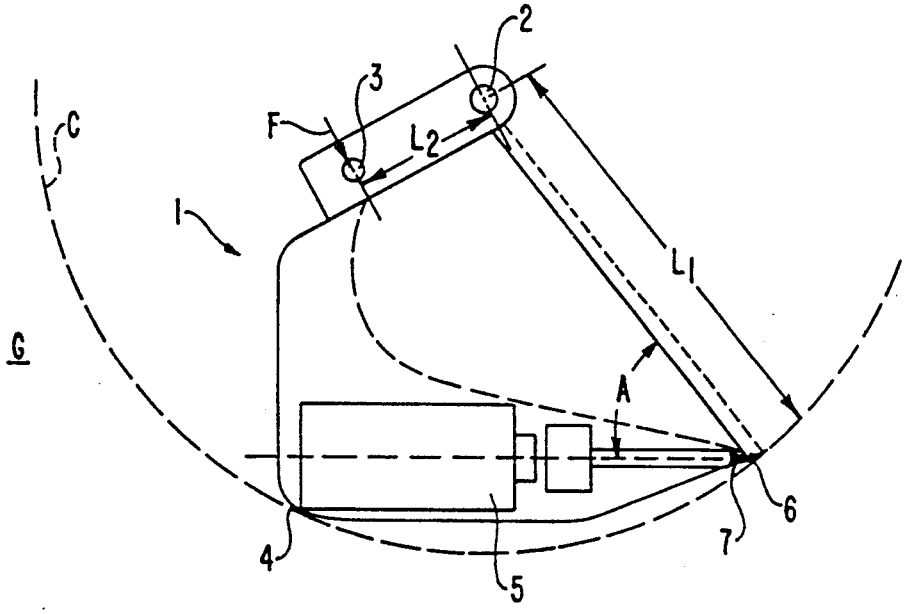
FIG. 10 is a side schematic view of an impact bucket in use, to illustrate design constraints.

An impact bucket 12 in accordance with the present invention comprises a bottom wall 14, a rear wall 16, a top wall 17, and a pair of side walls 18, 20 which collectively form a bucket cavity 22 (FIGS. 1 and 7-8). The bucket cavity is subdivided by an inner wall 24 into two sections including a scoop portion **22*a* for gathering the material to be removed and a hammer portion 22*b* for encasing the hammer unit 10 (FIGS. 2-3 and 7**).

Figure 2:
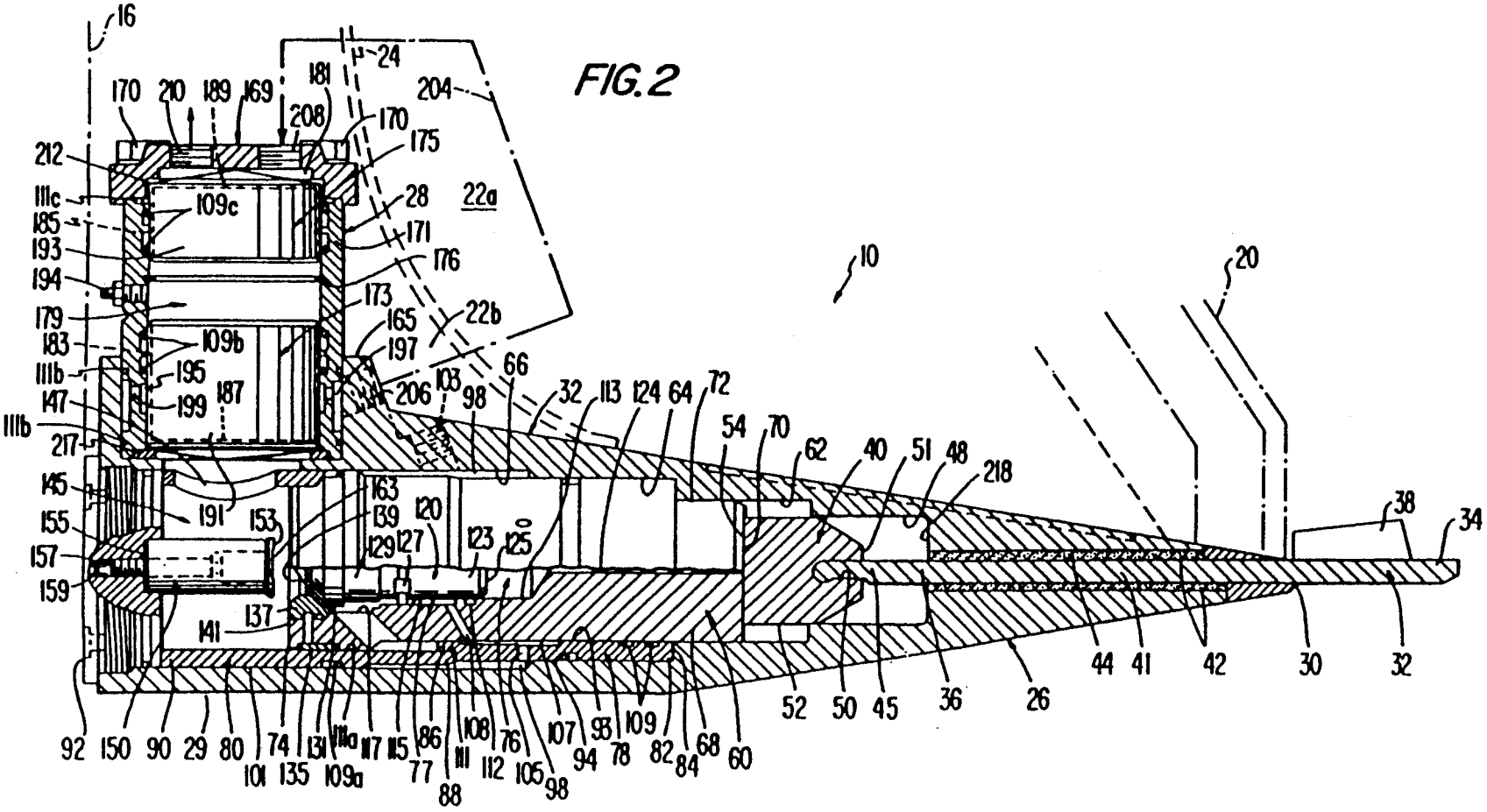
FIGS. 2 and 3 are cross-sectional views of the impact hammer unit positioned within the impact bucket at certain points in its operation.
Figure 3:
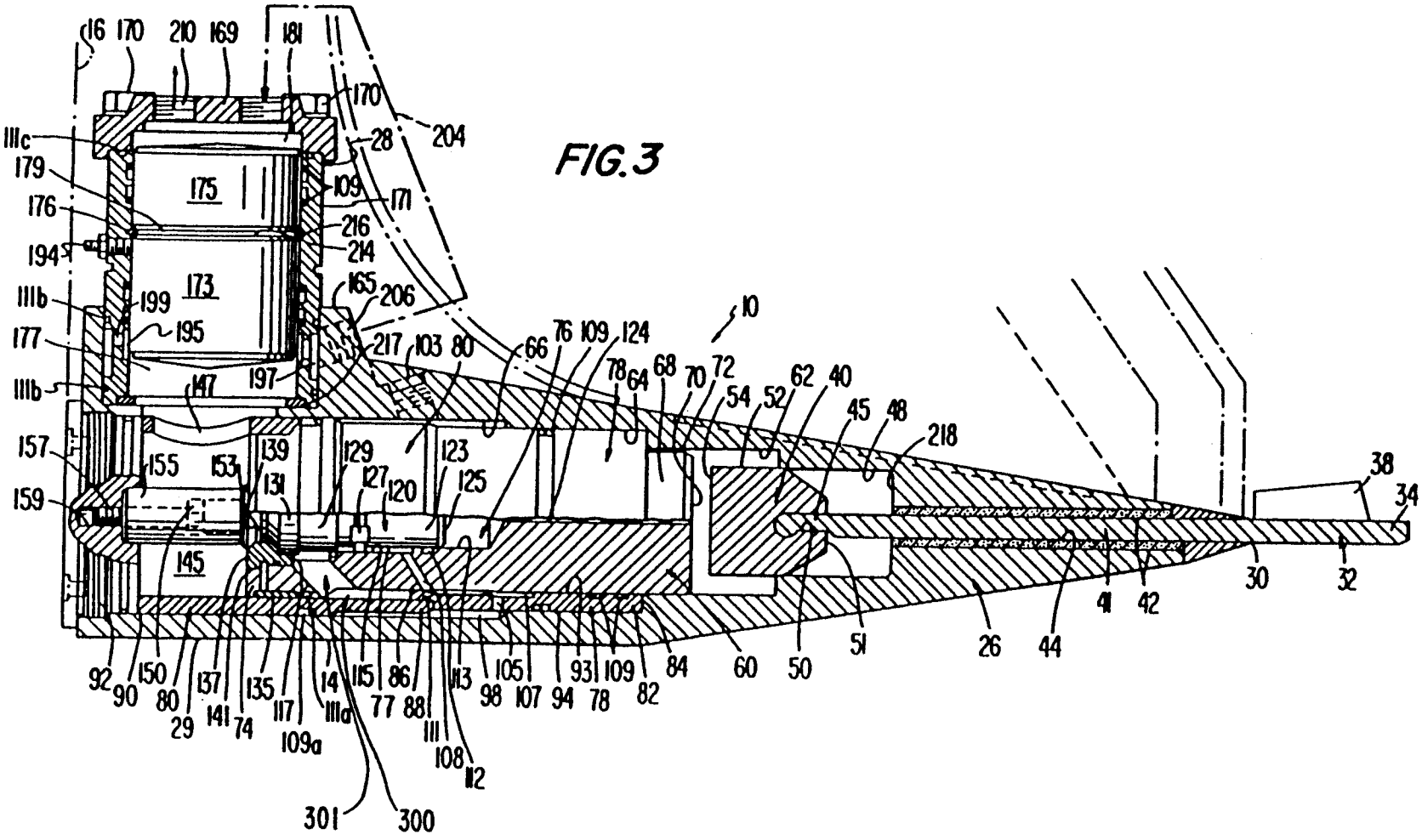

Impact hammer unit 10 comprises an elongated casing 26 and a piston cylinder 28 which cooperatively form a housing 29 for the unit (FIGS. 2 and 3). Casing 26 is positioned along the bottom of the bucket and preferably includes a bottom surface defining bottom wall 14 and an upper surface defining the bottom forward portion of inner wall 24. Casing 26 is a hollow member which defines a series of stepped openings extending from the bucket's front edge 30 to the rear wall 16. Cylinder 28 is also a hollow member which is attached to and fluidly connected to a rear portion of casing 26, as discussed in more detail below.

Figure 4:
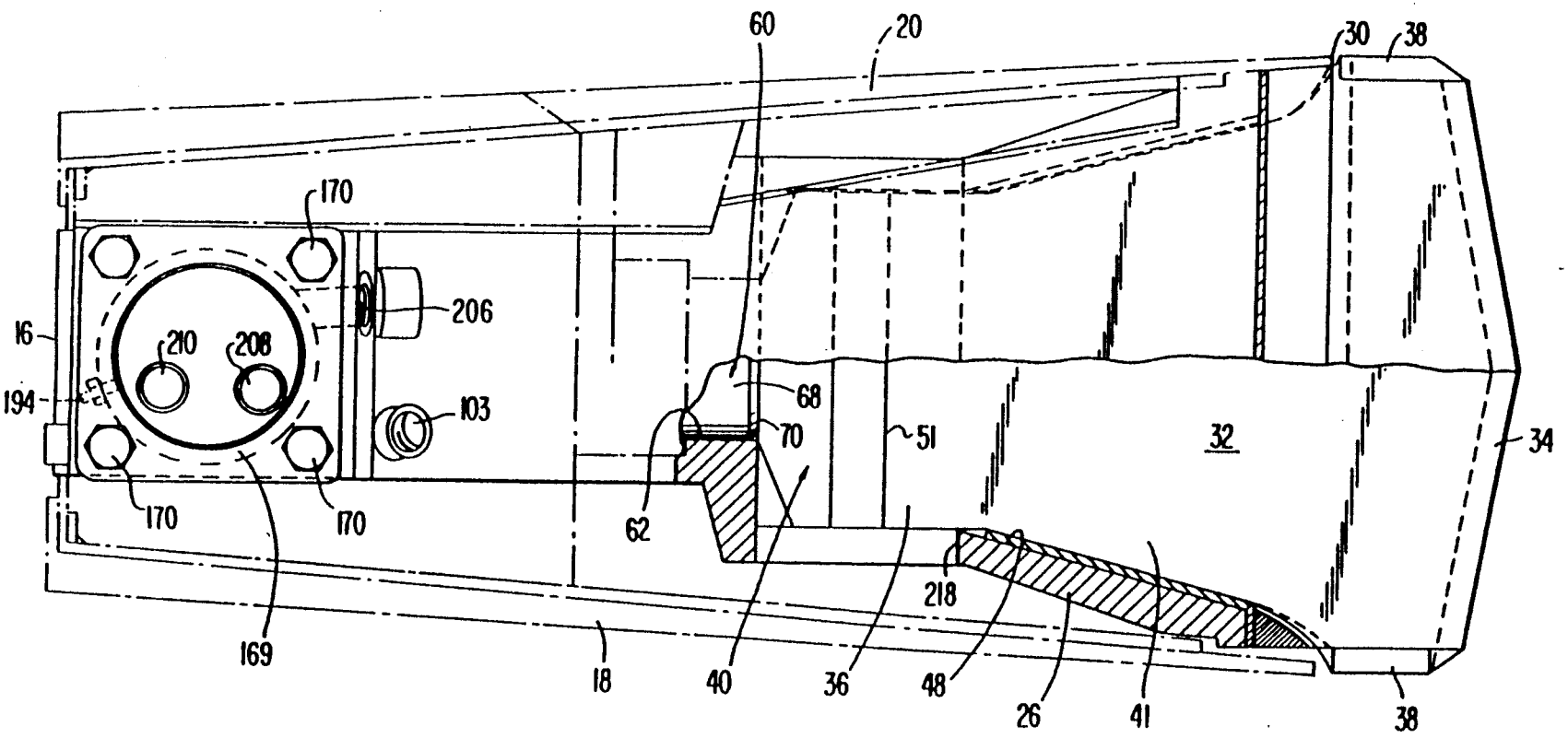
FIG. 4 is a partially broken top plan view of the hammer unit with certain fluid lines omitted and with the bucket shown in phantom lines.
Figure 6:
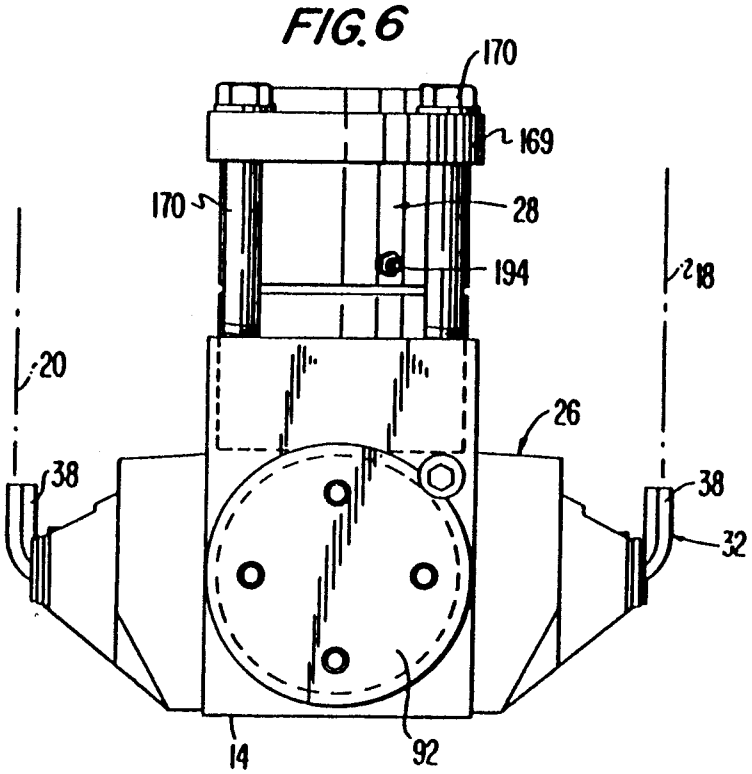
FIG. 6 is a rear elevational view of the impact hammer unit.
Figure 5:
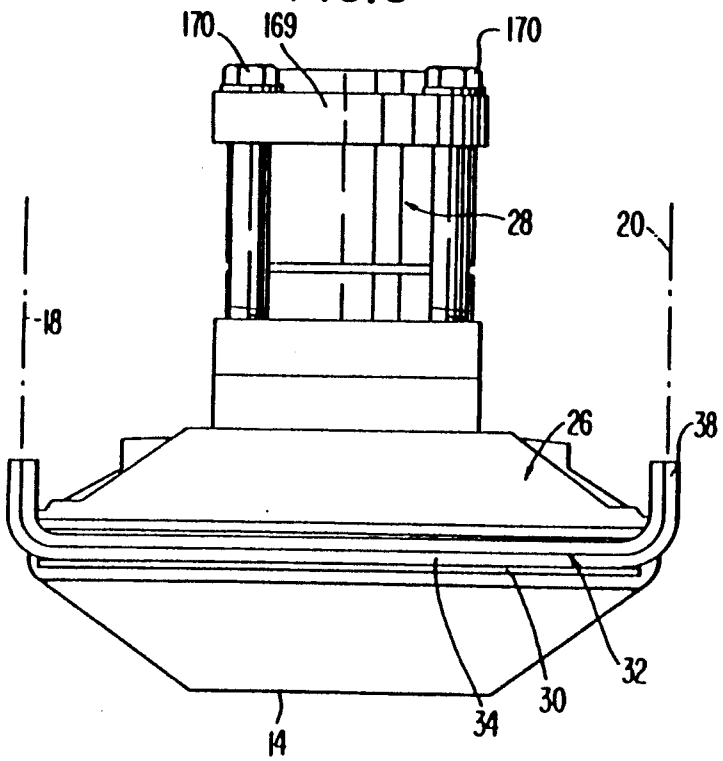
FIG. 5 is a front elevational view of the impact hammer unit.

The front edge of bucket 12 is defined by an impact blade 32 (FIGS. 2-4.) Blade 32 is a planar member having a leading end 34 and a base end 36. Leading end 34 extends across the entire width of the bucket and forms the material engaging portion of the tool element. In the preferred construction, leading end 34 has a generally broad, outwardly bowed V-shape to enhance its ability to penetrate the material (FIG. 4). Additionally, a pair of upright wings 38 are defined on the opposite sides of the blade's leading end to better separate the material for collection into the bucket (FIGS. 1-9). The wings 38 though are not essential to the unit's operation. Base end 36 of blade 32 is fixedly attached to anvil 40 reciprocally received in casing 26 (FIGS. 2-4). The medial portion 41 of blade 32 is movably supported by bearing sheets 42 positioned in opening 44 in the front end of casing 26. Bearing sheets 42 are preferably composed of polyethylene, but could be of any type of bearing having the requisite characteristics. In the preferred construction, the blade narrows rearwardly to reduce its size. Moreover, a relatively narrow rear segment 45 protrudes rearwardly to facilitate its attachment to anvil 40.

Anvil 40 is reciprocally received within a first opening 48 defined in casing 26 adjacent opening 44 (FIGS. 2-4). Anvil 40 is typically a generally rectangular block member having a mounting groove 50 in front face 51, side walls 52 and a rear impact face 54. Side wall 52 matingly engages the rear end of first opening 48 to ensure a linear motion of anvil 40 to avoid binding of the blade. The forward portion of opening 48 widens to accommodate the width of the blade (FIG. 4). Mounting groove 50 fixedly receives rear segment 45 (FIGS. 2 and 3). Preferably, anvil 40 slides into assembly with blade 45 through a slot in the sidewall of casing 26. The impact face 54 is a planar face adapted to receive repeated blows from head 60.

Head 60 is reciprocally received within bore 62 and sleeves 78 and 80 which in turn are received in successively stepped bores 64 and 66 (as described more fully below) to repeatedly strike anvil 40 (FIGS. 2 and 3). Head 60 is generally a cylindrical member including a massive end 68 having a striking face 70, a peripheral side wall 72, a rear end 74, and an internal cavity 76 primarily located in base end 74. Massive end 68 is a nearly solid portion which is adapted to be matingly received in second stepped bore 62. Striking face 70 is a planar surface which abutting strikes impact face 54 of anvil 40 with a considerable amount of force.

Cylindrical sleeve pair 78 and 80 are mounted in casing 26 about head 60 (FIGS. 2 and 3). More specifically, first sleeve 78 is matingly received within the third stepped bore 64 of casing 26. The front end 82 of sleeve 78 is abutted against the shoulder 84 defined between the second and third bores 62, 64. The rear end 86 of sleeve 78 is abutted against the forward end 88 of sleeve 80. The rearward end 90 of second sleeve 80 is, in turn, abutted against cap 92 closing the casing on its rear end. This construction holds sleeves 78, 80 in a fixed position in casing 26, and thereby precludes their movement with head 60.

The inner surface 93 of sleeve 78 matingly receives head 60 to maintain its linear motion. Sleeve 78 extends rearwardly from shoulder 84 through third bore 64 and into fourth bore 66. Hence, while the front portion of the outer surface 94 of sleeve 78 is matingly received within third bore 64, its rearward portion is spaced from the wall defining fourth bore 66. Similarly, the forward end 88 of second sleeve 80 is a reduced segment which is also spaced from wall for fourth bore 66. This spacing thus defines a cylindrical opening 98. Opening 98 is fluidly coupled with inlet 103 defined in casing 26 for supplying pressurized oil into the system. The oil is supplied via a pump and conduit (not shown).

Radial passages 105 are formed intermediate the length of sleeve 78 to interconnect opening 98 with an internal annular gap 107 (FIGS. 2 and 3). Gap 107 is defined between sleeve 78 and head 60. As can be appreciated, pressurized oil fed into the system by inlet 103 is passed to gap 107 via passages 105. The oil is then directed to head cavity 77 by head passages 108. An annular cavity 300 is further defined between the inner wall of sleeve 80 and the outer wall of head 60. Cavity 300 is fluidly coupled with head cavity 77 via large ports 301. To prevent leakage of the oil, sleeve 78 is provided with seals 109 along front end 82 and O-rings 111, 111*a* about the front end and rear end 86, respectively. Similarly, seals 109, 109*a* are also provided about the exterior of second sleeve 80. Of course, other sealing arrangements could be used.

Internal bore 76 of head 60 has a stepped configuration comprised mainly of three generally cylindrical segments 113, 115, and 117. The segments are designed to movably receive and support a poppet 120. As discussed more fully below, poppet 120 is used to activate the striking action of the unit. Inner segment 113 is shaped to matingly receive the inner shaft portion 123 of the poppet. As seen in FIGS. 2 and 3, inner segment 113 has a length which extends beyond shaft 123 to permit axial movement of the poppet. A vent passage 124, extending through massive end 68 of head 60, functions to vent segment 113 so that movement of the poppet is not hindered. A seal 112 is positioned between shaft 123 and the wall forming inner segment 113 to prevent leakage of the oil therepast. Segments 115 and 117 collectively form head cavity 77. Shaft 123 further includes a plurality of spaced apart radial nubs 127 which project outwardly to engage the wall forming medial segment 115. Nubs 127 stably hold poppet 120 in an axial orientation without hindering the passage of the oil. Poppet 120 also includes a body portion 129 and an enlarged head portion 131 relatively loosely received in outer segment 117.

Head 60 further includes an enlarged rear end 74 matingly received within sleeve 80. An O-ring 111*a* is wrapped about end 74 of head 60 to prevent seepage of the oil between head 60 and sleeve 80. In addition, an annular bearing 135 is provided about head 60 to lessen the frictional resistance to the reciprocal movement of the head. A seat 137 is mounted at the outlet 139 of head cavity 77, along rear face 141 of head 60. Seat 137 is shaped to match and seat head portion 131 of poppet 120. The seating arrangement prevents leakage of the oil around poppet 120.

Casing 26 further defines an oil chamber 145 rearward of head 60. Specifically, the sides of oil chamber 145 are defined by the inner surface of sleeve 80. A large orifice 147 is defined in the upper side of sleeve 80 to fluidly interconnect chamber 145 with piston cylinder 28. The rear of chamber 145 is formed by end cap 92. The front boundary of oil chamber 145 is formed by the rear face 141 of head 60.

A probe 150 is positioned generally in the center of oil chamber 145 (FIGS. 2 and 3). Probe 150 is a relatively narrow, elongated cylindrical element having an activating front end 153 and a mounting rear end 155. In the preferred construction, probe 150 has a stepped, hollow interior to receive a mounting bolt 157 therein. Bolt 157 is threadedly received into a threaded bore 159 defined in cap 92. The activating end 153 is aligned with poppet 120 and is preferably matingly received within the central opening 139 defined by seat 137. A plurality of notches 163 are defined in end 153 to allow oil to flow across the face of the poppet to drive the poppet down to an open position As seen in FIG. 2, head 60 and poppet 120 are spaced from probe 150 immediately after a blow has been delivered to anvil 40. However, as the head is driven rearward, by the inflow of oil through inlet 103, poppet 120 approaches and ultimately engages probe 150 (FIG. 3).

Casing 26 defines a boss 165 on the upper side of its rear end to form a mount for piston cylinder 28 (FIGS. 2 and 3). In particular, cylinder 28 is received within boss 165 and extends upwardly beyond casing 26. The positioning of cylinder 28 at a right angle to the head is an advantageous arrangement for maximizing the space within an impact bucket. However, the hammer unit 10 can be oriented such that the piston cylinder is axially aligned with head 60. The aligned construction would more suitably conform to the operation of an independent hammer unit. In any event, in the preferred construction, a cover plate 169 abuts against the upper end 171 of cylinder 28. A plurality of mounting bolts 170 are passed through the corners of cover plate 169 and into corresponding threaded bores (not shown) in casing 26, to securely hold cylinder 28 and cover plate 169 to casing 26 (FIGS. 2–6).

A power piston 173 and a drain accumulator piston 175 are movably mounted within piston cylinder 28 (FIGS. 2 and 3). Specifically, power piston 173 is positioned for movement within the lower regions of cylinder 28, while the drain accumulator piston 175 is positioned in the upper part thereof. A snap ring 176 is mounted within cylinder 28 to separate the pistons into their respective ends. The two pistons 173, 175 form three distinct chambers 177, 179 and 181 within cylinder 28. The first chamber 177 is positioned beneath power piston 173 and is thus an extension of oil chamber 145. The medial chamber 179, defined between the two chambers, is filled with a gaseous component, such as nitrogen gas ($N_2$). The upper chamber 181 is defined between accumulator piston 175 and cover plate 169.

Pistons 173, 175 are each preferably formed with an annular wall 183, 185 and a barrier wall 187, 189, respectively, to define generally cup-shaped pistons (FIG. 2). The barrier walls are arranged away from medial chamber 179 so that the inner cavities 191, 193 of pistons 173, 175 are filled with the pressurized gas and thereby form a part of chamber 179. With this construction, the pistons can be placed in closer proximity with each other to thereby conserve on space. As shown in FIGS. 2 and 3, appropriate seals 109*b*, 109*c* and O-rings 111*b*, 111*c* are mounted about cylinder 28 and pistons 173, 175 to prevent unwanted leakage of the oil and gas out of their confined areas. A fitting 194 is provided to facilitate the insertion of the gas into chamber 179.

To facilitate the enhanced operation of the hammer unit, upper chamber 181 is selectively interconnected with lower chamber 177. More specifically, an inner annular recess 195 is defined along the inner surface of a lower portion of cylinder 28, in the general vicinity of power piston 173. An outer annular recess 197 circumscribes inner recess 195 around the outer surface of cylinder 28. Outer recess is bounded on its outer side by boss 165 of casing 26. Inner and outer recesses 195, 197 are fluidly interconnected by a plurality of transverse passages 199. Outer recess 197 is further coupled with a closed tube 204 (shown schematically) via boss port 206 in casing 26. Closed tube 204 is, in turn, coupled with upper chamber 181 via inlet port 208 in cover plate 169. As will be described more fully below, closed tube 204 permits pressurized oil to be fed from oil chamber 145 to upper chamber 181 to drive accumulator piston 175 into the gaseous component in medial chamber 179. Cover plate 169 further defines a discharge port 210 to facilitate the draining of oil from upper chamber 181 to the reservoir (not shown).

Operation

FIG. 2 illustrates the position of the elements in hammer unit 10 at the beginning of a stroke (i.e., immediately following head 60 striking anvil 40). During operation, oil is continually pumped under pressure from the reservoir to opening 98 via inlet 103. Once the oil enters opening 98 it passes through radial passages 105 to gap 107. From gap 107, the oil passes into cavity 77 within head 60 by head passages 108. Oil also passes through head cavity 77 and into cavity 300 via ports 301. At this point, the oil in cavity 77 is at a higher pressure than the oil within oil chamber 145. As a result, head 60 and poppet 120 are moved toward end cap 92. This movement of head 60 toward probe 150 causes an increase in the size of cavity 300.

The oil used in the unit is virtually incompressible. Consequently, as head 60 is moved rearward, the oil in chamber 145 is forced upward against power piston 173. This pressure forces power piston 173 upward into the gaseous component in medial chamber 179. At this time, drain accumulator piston 175 is pressed against a shoulder 212 defined by cover plate 169 to prevent further upward movement of piston 175. Hence, the upward movement of power piston 173 works to shrink medial chamber 179 and thereby compress the gas therein.

This process continues until barrier wall 187 passes the lower edge of inner recess 195 in cylinder 28. At this point, excess oil in oil chamber 145 begins to flow out of lower chamber 177 and into inner recess 195. Once in recess 195, the oil flows through transverse passages 199 to outer recess 197. The oil then flows around outer recess 197 to boss port 206, where the oil passes into closed tube 204. Closed tube 204 directs the oil to upper chamber 181. The feeding of pressurized oil into upper chamber 181 by closed tube 204, causes accumulator piston 175 to be driven downward into the gaseous component in medial cavity 179. Hence, although the movement of the power piston 175 slows with the diverted flow of oil through closed tube 204, compression of the gas continues unabated with the descent of accumulator piston 175.

This movement of the head and the pistons continues until poppet 120 abuts against probe 150 (FIG. 3). At this point, the proximate ends 214, 216 of pistons 173, 175 are closely positioned to each other. As head 60 continues to be driven rearward by the incoming oil, probe 150 acts to separate poppet 120 from seat 137. The movement of poppet 120 further into inner segment 113 suddenly increases the available volume for the oil and thus creates a substantial pressure release which instigates the striking action. More specifically, the pressure release in the oil permits the gas to quickly expand and force power piston 173 downward toward stop 217. At the same time, accumulator piston 175 is forced upward against shoulder 212 in cover plate 169. This movement of accumulator piston 175 offers little resistance to hinder the explosive force created by the expanding gas because closed tube 204 is quickly closed off by the descending power piston 173. As a result, the resistance force behind accumulator piston 175 is lost. Further, the oil in upper chamber is discharged to the reservoir through discharge port 210. Due to the extraordinary speed of the operation, the discharge port is always open to permit continual drainage to the reservoir.

The downward movement of power piston 173 forces the oil against head 60 which is, in turn, forced forward toward anvil 40. Striking face 70 is then struck with great force against impact face 54 of anvil 40. The anvil transfers the force through blade 32 to impact the material to be broken. The force of blade 32 against the impacted material, keeps anvil 40 away from the front wall 218 of first opening 48. The forward movement of head 60 also functions to refill oil chamber 145 (i.e., to replace oil lost through closed tube 204) with the oil that is forced from cavity 300 and through ports 301 when the head is driven toward anvil 40.

During the striking operation, the oil is continually pumped from the reservoir into opening 98. From opening 98, the oil flows through passages 105, gap 107, head passages 108 and into cavity 77. Since the pressure in chamber 145 is spent in delivering the blow to anvil 40, the higher pressure in cavity 77 will move the poppet 120 against seat 137 and once again begin to move head 60 toward probe 150 for another cycle.

In this construction with a 1000 ft.lb. capacity, it is believed that a rate of about 560 blows per minute can be achieved. This would represent an increase of roughly 35% over the rates heretofore attainable. Moreover, the force with which the blow is delivered is also believed to be increased over conventional units of comparable size.

Of course, it is understood that the above are merely preferred embodiments of the invention, and that various other embodiments as well as many changes and alterations may be made without departing from the spirit and broader aspects of the invention as defined in the claims.

The embodiments of the invention in which an exclusive property or privilege is claimed are defined as follows:

1. An impact device comprising:

a tool element adapted to engage an item to be impacted;

a reciprocal head for striking the tool element with each reciprocation;

a first chamber filled with a fluid, said first chamber being positioned to one side of said reciprocal head such that said reciprocation of said head moves said fluid in said first chamber;

a movable first piston positioned to one side of said chamber such that said first piston is moved by said movement of said fluid in said chamber;

a movable second piston;

a second chamber filled with a gaseous component, said second chamber being associated with said first and second pistons such that said second chamber has a variable volume due to the movement of said pistons;

a third chamber fillable with said fluid, said third chamber being positioned to one side of said second piston;

a conduit interconnecting said first chamber with said third chamber so that said first and second pistons are each movable to compress said gaseous component in said second chamber; and an actuator for initiating expansion of said gas to drive said head against said tool element.

2. An impact device in accordance with claim 1, in which said conduit selectively interconnects said first and third chambers so that a portion of said fluid in said first chamber is selectively directed into said third chamber to provide a coordinated movement of said pistons.

3. An impact device in accordance with claim 2, in which said conduit interconnects said first and third chambers after an initial movement of said first piston to compress said gaseous component.

4. An impact device in accordance with claim 3, wherein said initial movement of said first piston is caused by said movement of said head into said first chamber.

5. An impact device in accordance with claim 4, in which said fluid is substantially incompressible.

6. An impact device in accordance with claim 1, wherein said actuator includes a probe positioned in said first chamber to interact with said head as it moves into said first chamber.

7. An impact device in accordance with claim 6, in which said head further includes a poppet movable between a closed position and an open position, wherein said probe selectively engages and moves said poppet to said open position as said head is moved into said first chamber to thereby initiate said expansion of said gas.

8. An impact device comprising:

a tool element adapted to engage an item to be impacted;

a movable head which moves to cyclically strike said tool element, said head being movable in return and advance directions;

a space filled with a gaseous component;

a piston assembly including a plurality of pistons associated with said head and said space so that each said piston is selectively moved to compress said gaseous component upon movement of said head in said return direction; and an actuator to cause said gaseous component to expand and drive said head in said advance direction to strike said tool element.

9. An impact device in accordance with claim 8, which further includes a housing defining at least one opening filled with a substantially incompressible fluid, wherein said head and said pistons are operatively associated with said fluid such that movement of said fluid causes the movements of said head and said pistons.

10. An impact device in accordance with claim 9, wherein said head includes a poppet movable between a closed position and an open position, and wherein said actuator includes a probe operatively associated with said poppet such that said probe selectively opens said head to initiate said expansion of said gaseous component.

11. An impact device in accordance with claim 9, in which said head and one of said pistons are operatively associated such that said one piston is moved to compress said gaseous component when said head is moved in said return direction.

12. An impact device in accordance with claim 11, in which the other of said pistons is operatively associated with said one piston such that said other piston is moved to compress said gaseous component after said one piston has moved to compress said gaseous component.

13. An impact device comprising:

a tool element adapted to engage an item to be impacted;

a movable head which moves to cyclically strike said tool element, said head being movable in return and advance directions;

a space filled with a gaseous component;

a piston assembly including a plurality of pistons associated with said head and said space so that each said piston is selectively moved to compress said gaseous component upon movement of said head in said return direction, said head and one of said pistons being operatively associated such that said one piston is moved to compress said gaseous component when said head is moved in said return direction, and the other of said pistons being operatively associated with said one piston such that said other piston is moved to compress said gaseous component after said one piston has moved to compress said gaseous component;

a housing defining at least one opening filled with a substantially incompressible fluid, said head and said pistons being operatively associated with said fluid such that movement of said fluid causes the movements of said head and said pistons;

a conduit to selectively direct said fluid from a side of said one piston to a side of said other piston to effect said movement of said other piston; and an actuator to cause said gaseous component to expand and drive said head in said advance direction to strike said tool element.

14. In an impact bucket having a bottom wall, side walls, and a rear wall collectively defining a cavity and an open front edge, and an impact unit for delivering a series of impacts to a material along at least a portion of said front edge, the improvement comprising the impact unit having:

a tool element extending beyond said front edge for impacting said material;

a reciprocal head positioned along one of said walls of said bucket for striking the tool element with each reciprocation;

a first chamber filled with a substantially incompressible fluid, said first chamber being positioned to one side of said reciprocal head such that said reciprocation of said head moves said fluid in said first chamber;

a movable first piston positioned to a side of said chamber other than said side occupied by said head such that said movement of said fluid caused by said reciprocation of said head causes said first piston to move;

a movable second piston;

a second chamber filled with a compressible gaseous component, said second chamber being defined between said first and second pistons such that said second chamber has a variable volume due to the movement of said pistons;

a third chamber fillable with said fluid, said third chamber being positioned to one side of said second piston opposite said second chamber;

a conduit selectively interconnecting said first chamber with said third chamber so that said first and second pistons are each selectively movable to compress said gaseous component in said second chamber; and an actuator for initiating expansion of said gas to drive said head against said tool element.

15. In an impact bucket in accordance with claim 14, wherein said pistons each defines a hollow interior which is filled with said gaseous component to form a part of said second chamber.

16. In an impact bucket in accordance with claim 14, wherein said actuator includes a probe positioned in said first chamber to interact with said head as it moves into said first chamber.

17. In an impact bucket in accordance with claim 16, in which said head further includes a poppet movable between a closed position and an open position, wherein said probe selectively engages and moves said poppet to said open position as said head is moved into said first chamber to thereby initiate said expansion of said gas.

18. In an impact bucket in accordance with claim 14, wherein said head is generally positioned along said bottom wall and said pistons are positioned generally along said rear wall.

19. An impact bucket comprising:

a bucket structure having a bottom wall, side walls, and a rear wall collectively defining a cavity and a front edge; and an impact unit for delivering a series of impacts to a material along said front edge member having:

a tool element adapted to engage said material to be impacted;

a movable head which moves cyclically to strike said tool element, said head being movable in return and advance directions;

a space filled with a gaseous component;

a piston assembly including a plurality of pistons associated with said head and said space so that each said piston is selectively moved to compress said gaseous component upon movement of said head in said return direction; and an actuator to cause said gaseous component to expand and drive said head in said advance direction to strike said tool element.

20. An impact bucket in accordance with claim 19, in which said impact unit further includes a housing defining at least one opening filled with a substantially incompressible fluid, wherein said head and said pistons are operatively associated with said fluid such that movement of said fluid causes the movements of said head and said pistons.

21. An impact bucket in accordance with claim 20, wherein said head includes a poppet movable between a closed position and an open position, and wherein said actuator includes a probe operatively associated with said poppet such that said probe selectively opens said head to initiate said expansion of said gaseous component.

22. An impact bucket in accordance with claim 20, in which said head and one of said pistons are operatively associated such that said one piston is moved to compress said gaseous component when said head is moved in said return direction, and in which the other of said pistons is operatively associated with said one piston such that said other piston is moved to compress said gaseous component after said one piston has moved to at least partially compress said gaseous component.

23. An impact bucket in accordance with claim 19, wherein said pistons each defines a hollow interior which is filled with said gaseous component to form a part of said space filled with said gaseous component.

24. An impact bucket in accordance with claim 19, wherein said head is generally positioned along said bottom wall and said piston assembly is positioned generally along said rear wall.

25. An impact bucket comprising:

a bucket structure including a bottom wall, side walls and a rear wall collectively defining a cavity and an open front; and a fluid driven impact unit including:

a tool element extending along said front end of said bucket structure for engaging an item to be impacted;

a reciprocal head which moves cyclically to strike said tool element, said reciprocal head being positioned for movement generally along said bottom wall between said rear wall and said tool element;

a piston cylinder positioned transversely to said head such that it extends generally along said rear wall of said bucket structure;

at least one piston in said cylinder, said at least one piston dividing said cylinder into at least one fluid filled chamber and at least one gas filled chamber, said piston being movable to compress said gas under sufficient fluid pressure and movable to drive said head to strike said tool element under the force exerted by expansion of said gas; and an actuator for initiating said expansion of said gas.

26. An impact bucket in accordance with claim 25, which further includes a plurality of pistons in said cylinder, wherein said pistons are each movable to compress said gas.

27. An impact bucket in accordance with claim 26 in which said pistons each has a hollow interior filled with said gas to thereby partially form said gas filled chamber.

* * * * *